US005448864A

United States Patent [19]

Rosamond

[11] Patent Number: 5,448,864

[45] Date of Patent: Sep. 12, 1995

[54] MULTI-LIGHT GLASS BLOCK PANEL ASSEMBLY AND METHOD

[76] Inventor: John E. Rosamond, 1732 NE. Woodridge La., Bend, Oreg. 97701

[21] Appl. No.: 319,063

[22] Filed: Oct. 6, 1994

Related U.S. Application Data

[63] Continuation of Ser. No. 79,709, Jun. 22, 1993, abandoned.

[51] Int. Cl.[6] ..... B44F 1/06

[52] U.S. Cl. ..... 52/307; 52/308

[58] Field of Search ..... 52/306, 307, 308, 591, 52/474, 475, 477, 668, 656.1

[56] References Cited

U.S. PATENT DOCUMENTS

| | | | |
|---|---|---|---|
| 2,354,054 | 7/1944 | Plym | 52/456 |
| 2,542,581 | 2/1951 | Schreffler | 72/41 |
| 3,193,434 | 7/1965 | Weiss | 161/6 |
| 3,358,412 | 12/1967 | Martin | 52/456 |
| 3,474,587 | 10/1969 | Martin | 52/456 |
| 4,843,772 | 7/1989 | Lisa | 52/308 |
| 5,003,744 | 4/1991 | Taylor | 52/308 |
| 5,014,471 | 5/1991 | Ballstadt . | |
| 5,031,372 | 7/1991 | McCluer | 52/307 |
| 5,042,210 | 8/1991 | Taylor | 52/307 |
| 5,079,886 | 1/1992 | Downs | 52/314 |

OTHER PUBLICATIONS

Trade Brochure, Weck Glass Block Company: How to Install "Weck" Glass Block.

Exhibit—Rosamond Pre-Fab Framed Glass Block Window Panel—Installed (the invention).

*Primary Examiner*—Carl D. Friedman
*Assistant Examiner*—Creighton Smith
*Attorney, Agent, or Firm*—Eugene D. Farley

[57] ABSTRACT

A multi-light glass block panel assembly adapted for pre-fab manufacture and application. A grid of perimeter and interior frame members having grooved interior faces seats in the grooves a plurality of glass blocks, one in each opening of the grid. A sealant such as a silicone sealant is interposed between the blocks and the adjacent frame members. In manufacture, the perimeter frame members are pulled tightly against the blocks, thereby securing them in their respective openings.

5 Claims, 3 Drawing Sheets

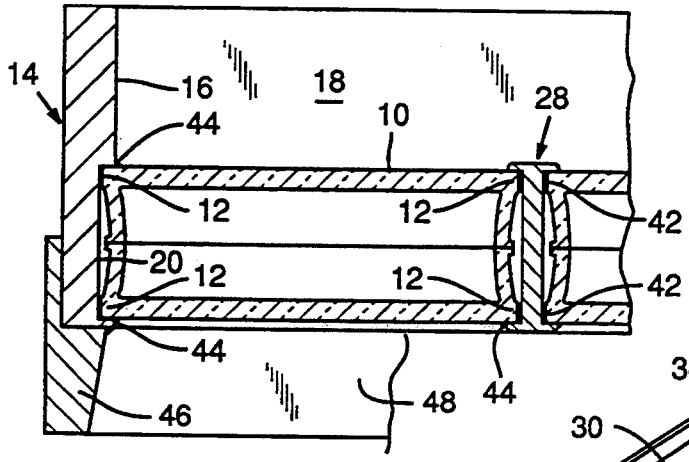
FIG. 5
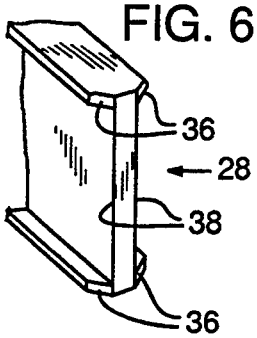
FIG. 6
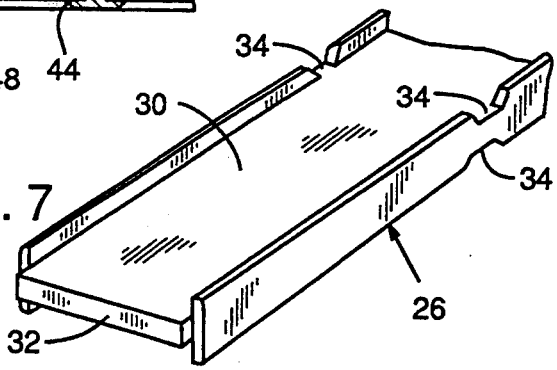
FIG. 7
FIG. 8
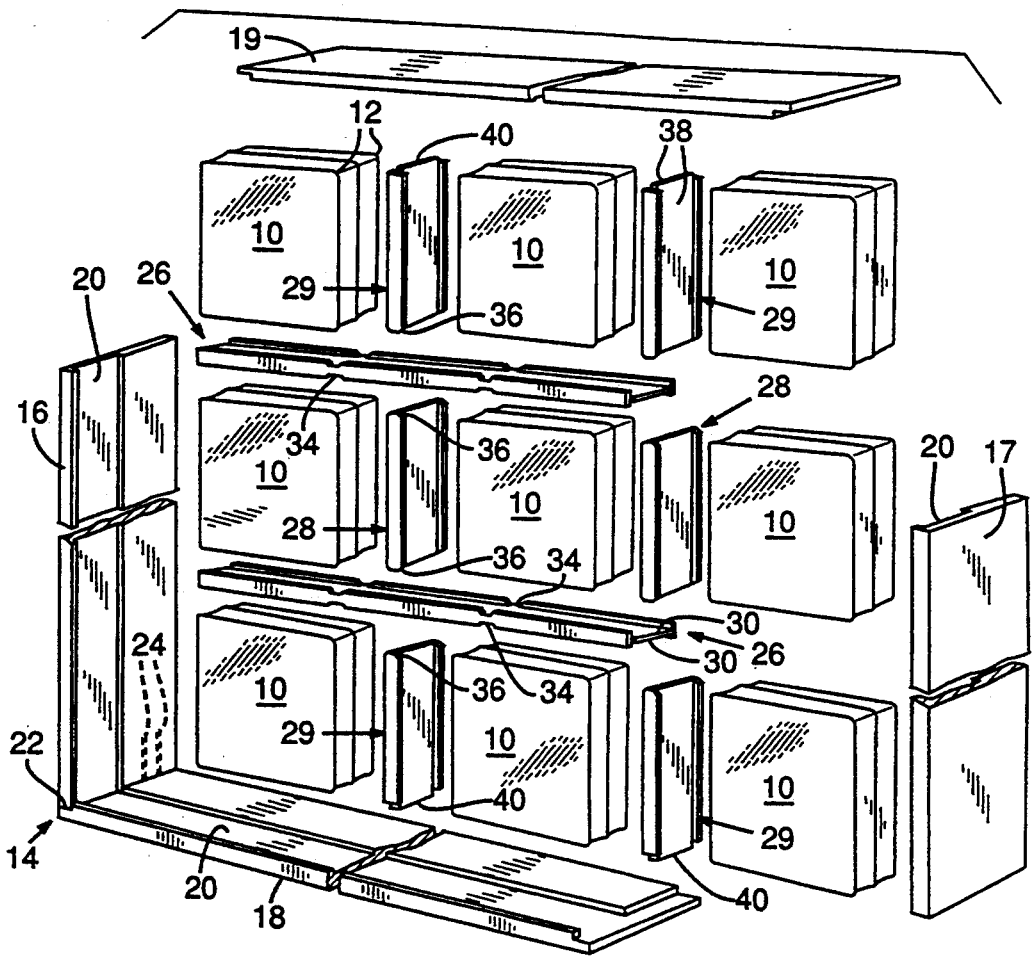

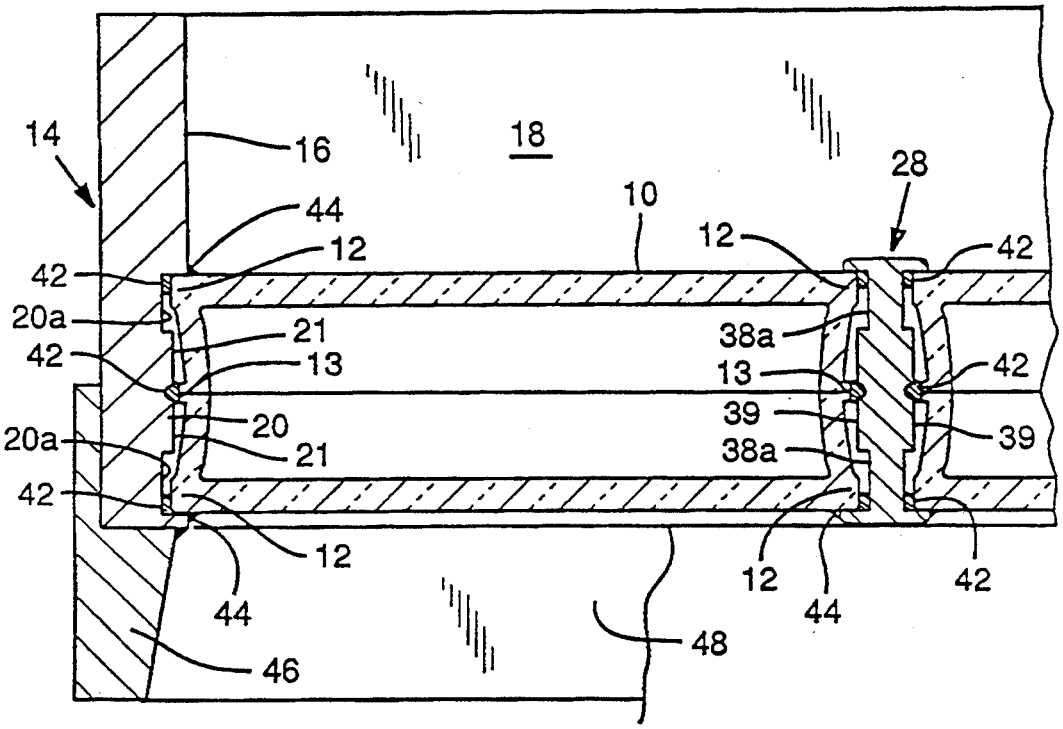
FIG. 9
FIG. 10
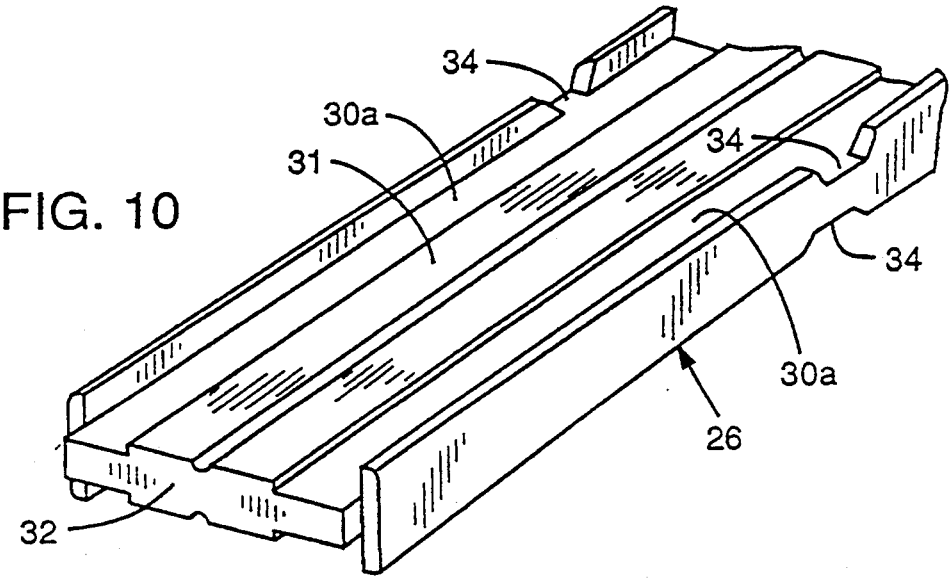

MULTI-LIGHT GLASS BLOCK PANEL ASSEMBLY AND METHOD

This application is a continuation of application Ser. No. 08/079,709, filed Jun. 22, 1993 now abandoned.

BACKGROUND OF THE INVENTION

1. Field of the Invention

This invention pertains to multi-light glass block panel assemblies and to a method for their manufacture. It pertains particularly to multi-light glass block panels used for constructional purposes in windows, doors, skylights and building walls and partitions.

2. Description of the Related Art

Because of their desirable ornamental and structural attributes multi-light glass block panels have long been used in such applications as those indicated above. They are widely employed where it is desired to provide panels which are attractive in appearance and which at the same time provide light and privacy to the associated living space. Because of their substantial size, weight and contour, the blocks, still are assembled into their end products using the techniques traditionally applied to the manipulation of bricks and other masonry products; that is, at the construction site they are painstakingly set in place in mortar. This tedious procedure, is disadvantageous for several reasons:

It is cumbersome, time consuming and costly.

It leads to the production of a glass block panel in which the blocks are improperly aligned, because of faulty workmanship, building settling, mortar squeeze, or other factors.

Since they are rigidly constrained by being set in mortar, the blocks are subject to cracking as the building of which they are components settles with the passage of time.

It is impossible to repair defects of misalignment and cracking without destroying and replacing the entire panel.

It is the general purpose of the present invention to provide a multi-light glass block panel assembly which will overcome the foregoing problems associated with the glass block panel assemblies of the prior art and which, in addition, may be the subject of prefab mass production techniques with attendant monetary savings. Also, the panels conform to conventional building practices and may be installed in conventional roughly framed openings and trimmed with conventional trim elements. Furthermore, the structure of the units associated with the glass blocks may totally comprise wood structural units with the result that the final panel product is of pleasing appearance and entirely compatible with the other components of a wooden building.

It is a further object of the present invention to provide a method for making the hereindescribed multi-light glass block panel which results in the production of a pre-fab panel of any desired size or shape and of which the component glass block are held securely in place during transportation, storage and use but which at all times are held flexibly in position so that they are not subject to breakage or loss from the panel.

SUMMARY OF THE INVENTION

The foregoing and other objects of the invention are accomplished by means of a multi-light glass block panel assembly which, broadly considered, comprises top, bottom and side perimeter frame members having rabbeted (grooved) inside faces; a plurality of interior frame members having rabbeted (grooved) opposite faces; and a plurality of glass panel blocks. The frame members are assembled to provide a grid of framed openings. Each opening receives a glass block seated in the rabbeted surfaces of the adjacent frame members. The perimeter members are arranged in end-to-end frame-forming relation in which relation they secure in place the blocks and the interior frame members. Structural sealing material is applied to the inner faces between the blocks and the adjacent frame members. This accomplishes two functions; first, it provides a weather seal and second it imparts flexibility to the final assembly.

The method by which the above described multi-light glass block panel is fabricated broadly comprises providing a plurality of perimeter frame members having grooved inside faces, a plurality of inside frame members having grooved opposite faces, and a plurality of glass blocks. Part of the perimeter frame members are arranged end-to-end in partial frame-forming relation, with their grooved faces directed inwardly and their meeting ends together. A grid of alternating glass blocks and interior frame members is assembled within the partial frame. Structural sealant is applied to the interfaces between the glass blocks and the frame members. While assembling the grid, the blocks are seated in the grooves of the adjacent frame members.

The remaining outside frame members then are arranged end-to-end and with the component frame members of the partial frame, drawn together and secured to form the completed frame. This locks the glass blocks seated within the grooves, inside the grid, to form a final pre-fab product.

THE DRAWINGS

In the drawings:

FIG. 5 is a fragmentary, detailed sectional view taken along line 5—5 of FIG. 2.

FIG. 6 is a fragmentary view in perspective of a vertical interior frame member which is a component of the glass block assembly of the invention.

FIG. 7 is a fragmentary top perspective view of a horizontal interior frame member which is a component of the glass block assembly, FIG. 8 is a partial, exploded view in perspective, similar to FIG. 1, but illustrating the components of the glass block assembly in their relationship to each other.

FIGS. 9 and 10 are views similar to FIGS. 5 and 7, but illustrating the invention in another of its embodiments.

DESCRIPTION OF A PREFERRED EMBODIMENT OF THE INVENTION

Figure 1:
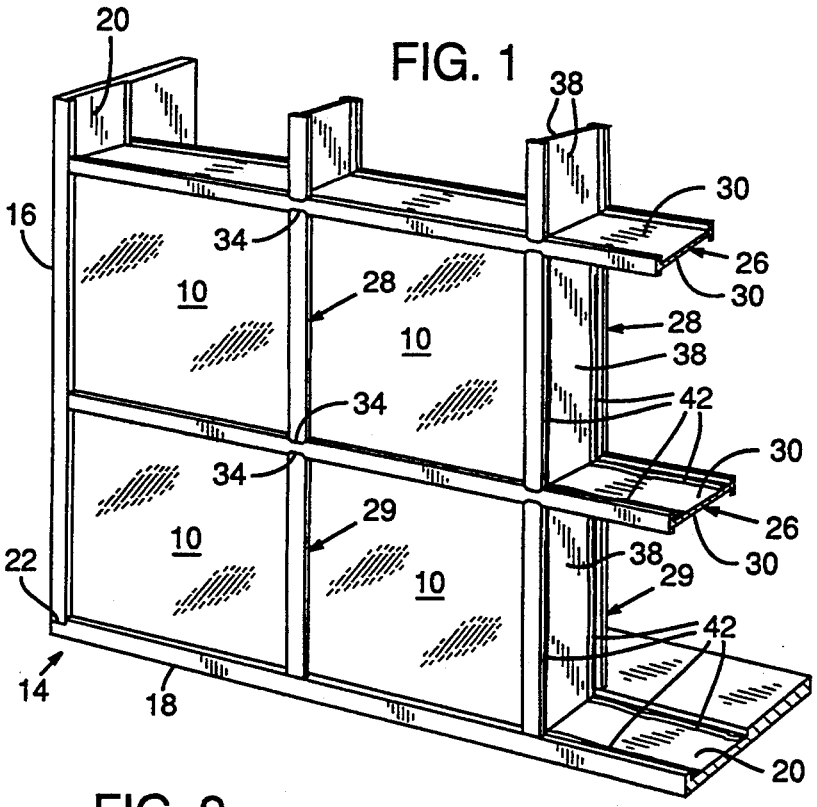
FIG. 1 is a fragmentary view in top perspective of the herein described multi-light glass block panel assembly.

Referring to FIGS. 1 and 8.

The multi-light glass block panel assembly of my invention is designed for use with a plurality of glass blocks 10. These normally are rectangular in shape and may include marginal ribs 12, one on each side, as well as a central rib. 13. The blocks are obtainable in various sizes from various commercial sources such as the Pittsburg-Corning Company. Their application is described herein in an assembly of rectangular configuration. However, by use of suitable filler pieces, not illustrated, they may be included in assemblies of various other configurations as desired.

Blocks 10 are incorporated in a framing structure which includes a perimeter or outside frame indicated generally at 14. This frame is comprised of a pair of vertical side or jamb pieces 16, 17 and a pair of horizontal pieces: a lower or sill piece 18 and an upper or header piece 19, FIG. 8.

These four elements of the assembly may be of identical constructions and are of a size to suit the size of the contemplated panel. The inside face of each is rabbeted or grooved to provide a continuous channel or groove 20 about the inside face of the frame. For an outside window, this channel preferably is located toward the outside margin of the frame. For an inside window or panel, it preferably is located centrally of the frame.

The ends of the outside frame pieces are suitably jointed and adapted to be assembled in end-to-end relation. Adjacent pieces are interconnected in frame-forming relation by suitable securing means, for example by means of glue 22 and prong-type fasteners 24 (staples in the illustration).

Associated with outside frame 14 is an inside frame arranged as a grid which locates and retains in position individual ones of glass blocks 10.

The interior frame is comprised of horizontal members 26 and vertical members 28, 29.

Horizontal members 26 have on opposite faces rabbets or grooves 30 extending the entire length of each frame member. Their ends are shaped with tongues 32, FIG. 7, dimensioned to fit in rabbets 20 of side jambs 16, 17. Intermediate their ends are one or a plurality, depending upon the size of the panel, of miter joint elements 34. These are spaced at distances corresponding to the dimensions of the adjacent glass blocks. They serve to receive and locate vertical inside frame members 28, 29 to insure proper spacing of the blocks.

Horizontal inside frame members 26 have a length predetermined to span the distance between opposite jamb members 16, 17. They preferably extend the entire width of the panel. Vertical inside frame members 28, 29 on the other hand, have a length such as to span the distance between a horizontal inside frame member 26 and one of the outside frame members 18, or between adjacent horizontal inside frame members 26, depending upon the size of the panel.

Vertical inside frame members of category 28 are formed on both ends with miter joint elements 36. These mate with miter joint elements 34 in horizontal interior frame member 26. Both faces of frame member 28 are formed with rabbets or grooves 38.

Vertical interior frame members 29 which are used in conjunction with top or bottom exterior frame members 18, 19 are provided at one end with a tongue 40, FIG. 8, rather than with a miter joint component.

A suitable sealant is employed for sealing the joints between the glass blocks and the surrounding frame members. Although a plastic sealant such as a plastic silicone sealant 42 is preferred, other types of sealants also may be employed. For example, before installation in their respective frames, the glass blocks may be wrapped with a layer of a solid, tape such as "Mylar" backed, closed cell, sponge vinyl, compressible and self-adhesive sealing tape which conventionally is used around doors, hatches and windows for weather sealing purposes.

In the embodiment of FIGS. 9 and 10, a frame construction is provided which takes advantage of central rib 13 on glass block 10 and provides an assembly of improved thermal insulation and weather resistance qualities.

In this embodiment the interior channel or groove **20*a* of outside frame 14 has a central land 21 opposite and substantially meeting central rib 13 of the adjacent blocks 10. A ribbon 42** of sealant is interposed between the meeting surfaces.

Similarly the central channel or groove **30*a* of horizontal members 26 and the central channel or groove 38*a* of vertical interior frame members 28, 29, are provided with centrally located lands 31, 39 respectively. Again, sealant ribbons 42** are employed to effect a weatherproof seal.

As a result of this construction, a pair of sealed pockets or chambers are provided, one on each side of each glass block rib 13. These contribute the desired capability of imparting to the assembly improved thermal insulation qualities and improved weather resistance.

It will be seen that the frame elements of the panel are adapted to be made from wood, plastic or metal by simple manufacturing methods. They may be made in numbers and applied to the manufacture of the panels by the procedures of mass production.

Figure 3:
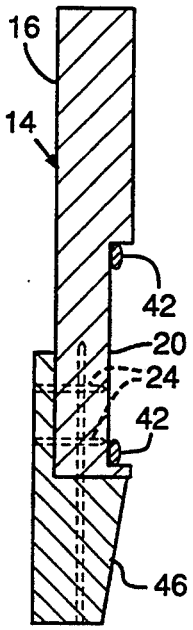
FIG. 3 is a detailed sectional view taken along line 3—3 of FIG. 2.
Figure 2:
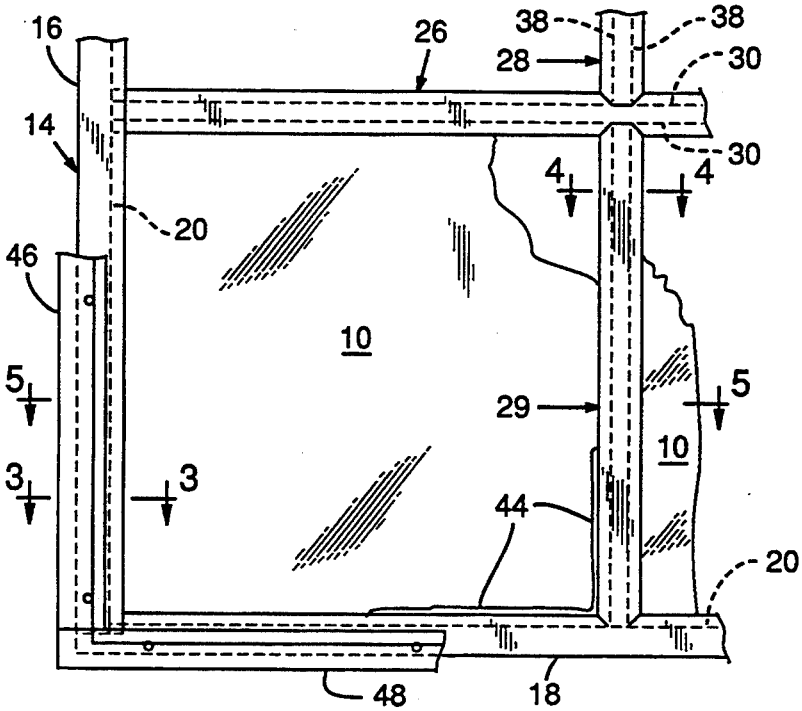
FIG. 2 is a fragmentary view in elevation of the assembly in its installed condition, with trim partially applied.
Figure 4:
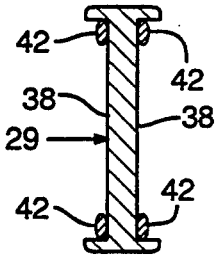
FIG. 4 is a detailed sectional view taken along line 4—4 of FIG. 2.

A preferred procedure for assembling the components into the finished panel is as follows:

First a partial frame is constructed in a U-shaped configuration, open on one of its sides. As illustrated in FIG. 8, this is accomplished by assembling jamb pieces 16, 17 and sill piece 18 in a U-shaped configuration, preferably vertically oriented, and securing the meeting ends by means of the application of glue 22 and staples 24. Next a suitable sealant is applied to the continuous channel formed by rabbets 20, 30, FIGS. 3 and 4. The sealant may comprise to advantage ribbons 42 of a conventional structural sealing material such as a silicone sealant. This material preferably is applied as a ribbon in the area of the rabbets which is contacted by ribs 12 in glass blocks 10 in the final assembly. This ensures an effective seal.

Next one of glass blocks 10 is seated in the rabbet or groove provided by outside frame elements 16, 18 and pressed into the silicone ribbons.

A ribbon of sealant next is applied to the grooved faces of the lowermost of vertical inside frame members 28. The tongue 40 of this element then is inserted into rabbet 20 of sill frame member 18 after which the element is pressed closely adjacent to block 10.

The lower margin of the second block 10 next is seated in the groove. If the panel is to be only two blocks wide, vertical outside jamb member 17 next is applied. However, if the panel is to be wider, the desired number of blocks are built into the partial frame in sequence in the manner indicated.

If the window is to be constructed with a second course of blocks, horizontal inner frame member 26 is supplied with appropriately placed ribbons of sealant 42 and superimposed on the first course, with its miter joint elements 34 receiving the miter joint elements 36 of vertical frame pieces 28, thus locating the blocks properly and ensuring proper alignment.

The second course of glass blocks then is superimposed on the horizontal interior frame member, being received in the rabbeted upper surface thereof. This procedure continues until the desired number of courses has been applied.

Top outside frame piece 19 next is applied, again using glued and stapled joints. In effect, this procedure "bundles up" all of the interior components. It assures that all of the components are pressed together and seated in the adjacent frame components. Any misalignment of frame pieces or blocks may be adjusted at this stage, since the sealant still is soft.

Caulking 44 next is applied to the joints between the frame pieces and the glass on the exterior of the panel.

As noted, it is a feature of the invention that the panels may be finished off and mounted in the manner which is characteristic of wooden windows. Thus, in the construction of the building rough openings corresponding to conventional window openings may be built in. The presently described glass block window assemblies then may be mounted in the openings and nailed to the framing in the usual manner.

Suitable decorative molding elements next may be applied. In the illustrated form of the invention, such elements comprise "brick molding" strips 46 nailed or otherwise secured to the top and sides of the unit. A cooperating sill element 48, FIG. 5, is applied to its bottom to drain away water during inclement weather.

Having thus described in detail a preferred embodiment of the invention, it will be apparent to those skilled in the art that many physical changes may be made in the apparatus without altering the inventive concepts and principles embodied therein. The present embodiment is therefore to be considered in all respects as illustrative and not restrictive, the scope of the invention being indicated by the appended claims.

I claim:

1. A multi-light glass block panel assembly comprising:

a) top, bottom and perimeter frame members having grooved inside faces and inwardly projecting central lands, thereby forming a pair of laterally spaced grooves in each inside face, b) a plurality of interior frame members having opposite faces and central lands, thereby providing a pair of laterally spaced grooves on each opposite face, c) a plurality of glass panel blocks each having outwardly projecting, laterally spaced marginal and central ribs, d) the frame members being assembled to provide a grid of framed openings, each receiving a glass block with the marginal ribs thereof seated in the laterally spaced grooves of the adjacent frame members and with the central ribs registering with the inwardly projecting central lands, e) spaced apart marginal seal means interposed between the grooves and the marginal ribs and central seal means interposed between the lands and the central ribs, thereby forming insulating pockets between each block and the adjacent frame members, f) the perimeter frame members being arranged in end-to-end frame-forming relation, and securing means securing the perimeter frame members in their end-to-end frame forming relation, thereby retaining the glass blocks locked in their respective framed openings.

2. A multi-light glass block panel assembly of a plurality of horizontally and vertically arranged glass blocks comprising:

a) a plurality of glass panel blocks each having outwardly projecting spaced marginal and central ribs, b) top, bottom and side perimeter frame members having inside faces provided with laterally spaced grooves and central lands, arranged end-to-end in frame-forming relation, c) at least one horizontal interior frame member having opposite faces provided with laterally spaced grooves and central lands and dimensioned and contoured for placement in horizontal orientation between vertically adjacent courses of blocks, substantially abutting the side frame members, d) a plurality of vertical interior frame members having opposed faces provided with laterally spaced grooves and central lands dimensioned and contoured for placement in a vertical orientation between horizontally adjacent blocks, e) the frame members being assembled to provide a grid of framed and grooved openings, each receiving a glass block with the marginal ribs seated in the grooved faces of adjacent frame members and with the central ribs registering with the central lands.

f) spaced apart marginal seal means interposed between the grooves and the marginal ribs and central seal means interposed between the lands and the central ribs, thereby forming insulating pockets between each block and the adjacent frame members, and g) securing means securing the perimeter frame members in their end-to-end frame forming relation, thereby retaining the glass blocks locked in their respective openings.

3. A multi-light glass block panel assembly of a plurality of horizontally and vertically arranged glass blocks, comprising:

a) a plurality of glass panel blocks each having spaced marginal and central ribs, b) top, bottom and side perimeter frame members having grooved inside faces and central lands, arranged end-to-end in frame-forming relation, c) at least one horizontal interior frame member having grooved opposite faces and central lands and dimensioned and contoured for placement in horizontal orientation between vertically adjacent courses of blocks, substantially abutting the side frame members, d) a plurality of vertical interior frame members having grooved opposed faces and central lands, dimensioned and contoured for placement in a vertical orientation between horizontally adjacent blocks, e) the frame members being assembled to provide a grid of framed and grooved openings, each receiving a glass block with the marginal ribs seated in the grooved faces of adjacent frame members, f) spaced apart seal means between the marginal ribs of the glass blocks and the grooves in the frame members, g) miter joint means between the vertical interior frame members and the horizontal frame members, for positioning the vertical interior frame members and stabilizing the panel assembly, and h) securing means securing the perimeter frame members in their end-to-end frame-forming relation, thereby retaining the glass blocks locked in their respective openings.

4. A multi-light glass block panel assembly comprising:

a) top, bottom and side perimeter frame members having grooved inside faces, b) a plurality of interior frame members having grooved opposite faces, c) a plurality of glass panel blocks each having outwardly projecting laterally spaced marginal ribs, d) the frame members being assembled to provide a grid of framed openings, each receiving a glass block with its marginal ribs seated in the grooved faces of the adjacent frame members, thereby forming interfaces between the frame members and blocks, e) a plastic, sealant applied to said interfaces, f) the perimeter frame members being arranged in end-to-end frame-forming relation, and g) securing means securing the perimeter frame members in their end-to-end frame-forming relation, thereby retaining the glass blocks locked in their respective framed openings, h) the plastic, sealant having properties predetermined to enable correction of any misalignment of the assembly components in the assembled condition thereof.

5. The glass block panel assembly of claim 4 wherein the sealant comprises silicone resin sealant.

* * * * *